US012157048B2

(12) United States Patent
Yamada et al.

(10) Patent No.: US 12,157,048 B2
(45) Date of Patent: Dec. 3, 2024

(54) BASEBALL OR SOFTBALL GLOVE

(71) Applicant: MIZUNO CORPORATION, Osaka (JP)

(72) Inventors: Yuki Yamada, Osaka (JP); Kenji Maeda, Osaka (JP); Kazuhiro Kume, Osaka (JP); Akihiro Kanda, Osaka (JP); Yuya Motegi, Osaka (JP)

(73) Assignee: Mizuno Corporation, Osaka (JP)

( * ) Notice: Subject to any disclaimer, the term of this patent is extended or adjusted under 35 U.S.C. 154(b) by 78 days.

(21) Appl. No.: 17/973,643

(22) Filed: Oct. 26, 2022

(65) Prior Publication Data

US 2023/0136834 A1 May 4, 2023

(30) Foreign Application Priority Data

Oct. 29, 2021 (JP) ..... 2021-178042

(51) Int. Cl.
*A63B 71/14* (2006.01)
*A63B 102/18* (2015.01)

(52) U.S. Cl.
CPC ..... *A63B 71/143* (2013.01); *A63B 2102/18* (2015.10); *A63B 2102/182* (2015.10)

(58) Field of Classification Search
CPC ..... A63B 71/143; A63B 71/14
See application file for complete search history.

(56) References Cited

U.S. PATENT DOCUMENTS 5,379,460 A * 1/1995 Aoki ..... A63B 71/143 2/161.1
6,516,471 B1 * 2/2003 Baumann ..... A63B 71/143 2/19
2006/0090236 A1 * 5/2006 Aoki ..... A63B 71/143 2/19

FOREIGN PATENT DOCUMENTS

JP 2009-131621 A 6/2009
JP 6504712 B2 * 4/2019
JP 202129572 A 3/2021

OTHER PUBLICATIONS

English translation of JP2021029572 to Mizuno, accessed via espacenet.com (last visited Feb. 28, 2024). (Year: 2024).*
1 Notice of Grounds of Rejection dated Jun. 13, 2023 issued in Japanese Patent Application No. 2021-178042.

* cited by examiner

*Primary Examiner* — Patrick J. Lynch
(74) *Attorney, Agent, or Firm* — Troutman Pepper Hamilton Sanders LLP; James E. Schutz; Korbin M. Blunck

(57) ABSTRACT

The baseball or softball glove includes a thumb part, an index finger pan, and a web. The web includes a first protrusion and a second protrusion. The first protrusion has a first through hole. The second protrusion has a second through hole. At least either the first through hole or the second through hole has an inclined edge that extends obliquely upward from a base of the thumb part or the index finger part on a peripheral edge forming the through hole. The first protrusion and the second protrusion are engaged with each other in a state where the first through hole and the second through hole are connected to each other in a chain shape.

3 Claims, 19 Drawing Sheets

BASEBALL OR SOFTBALL GLOVE

This nonprovisional application is based on Japanese Patent Application No. 2021-178042 filed on Oct. 29, 2021 with the Japan Patent Office, the entire contents of which are hereby incorporated by reference.

BACKGROUND OF THE INVENTION

Field of the Invention

The present invention relates to a baseball or softball glove.

Description of the Background Art

Conventionally, a baseball or softball glove is required to be easy to close. Japanese Patent Laying-Open No. 2021-29572 discloses a baseball or softball glove capable of improving ease of closing.

The baseball or softball glove disclosed in Japanese Patent Laying-Open No, 2021-29572 includes a web. The web includes a first protrusion protruding from a thumb part toward an index finger part and a second protrusion protruding from the index finger part toward the thumb part. The first protrusion and the second protrusion are configured to be relatively movable by opening and closing the baseball or softball glove. Thus, when the baseball or softball glove is closed, a distance between the thumb part and the index finger part can be decreased without stress. Accordingly, the thumb part and the index finger part can be sufficiently brought close to each other. Therefore, the ease of closing of the baseball or softball glove can be improved.

There is a room for improvement in a movable range of the web in the baseball or softball glove disclosed in Japanese Patent Laying-Open No. 2021-29572.

SUMMARY OF THE INVENTION

The present invention has been made in view of the above problem, and an object of the present invention is to provide a baseball or softball glove capable of expanding a movable range of a web.

A baseball or softball glove of the present invention is intended to be worn on a hand of a wearer. The baseball or softball glove includes a thumb part, an index finger part, and a web. The thumb part is configured to receive a thumb of the hand of the wearer. The index finger part is configured to receive an index finger of the hand of the wearer. The web is disposed between the thumb part and the index finger part. The thumb part and the index finger pan include a base part and a fingertip part. The web includes a first protrusion and a second protrusion. The first protrusion has a first through hole. The second protrusion has a second through hole. At least either the first through hole or the second through hole has an inclined edge that extends obliquely upward from a base of the thumb part or the index finger part on a peripheral edge forming the through hole. The first protrusion and the second protrusion are engaged with each other in a state where the first through hole and the second through hole are connected to each other in a chain shape.

The baseball or softball glove of the present invention can expand a movable range of the web.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, embodiments of the present invention will be described with reference to the drawings. In the following drawings, unless otherwise specified, the same or corresponding parts are denoted by the same reference signs, and the description thereof will not be repeated.

First Embodiment

With reference to FIGS. 1 to 4, a configuration of a baseball or softball glove 1 according to a first embodiment of the present invention will be described. In the first embodiment of the present invention, a baseball or softball glove is exemplified as baseball or softball glove 1, but baseball or softball glove 1 according to the first embodiment of the present invention may be a catcher's mitt, a first base mitt, or the like.

Figure 1:
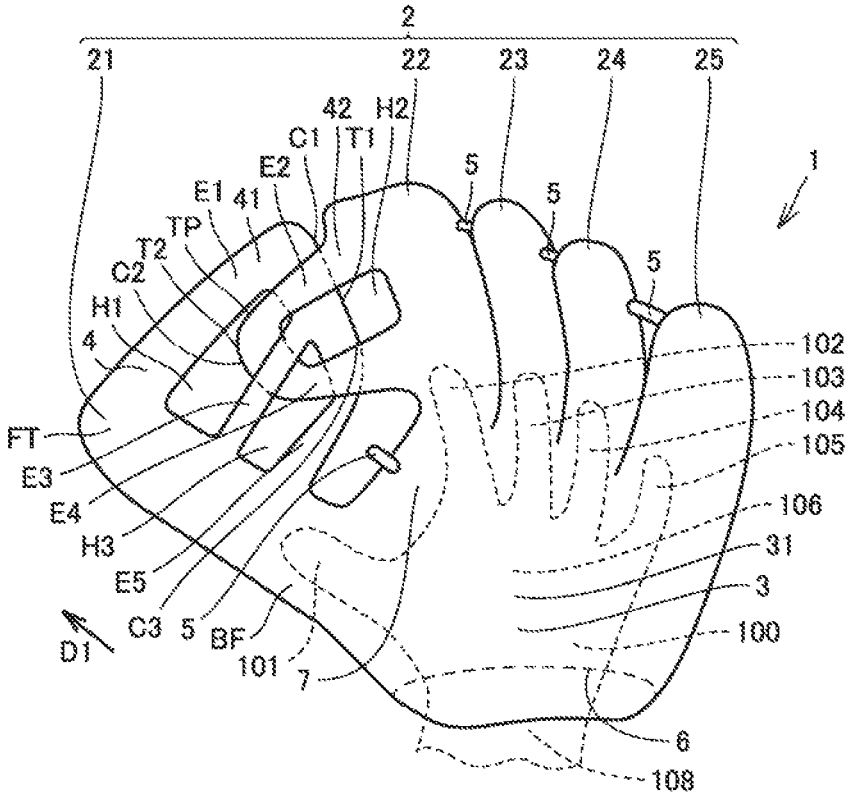
FIG. 1 is a front view generally showing a configuration of a baseball or softball glove according to a first embodiment of the present invention as viewed from a ball receiving surface.
Figure 2:
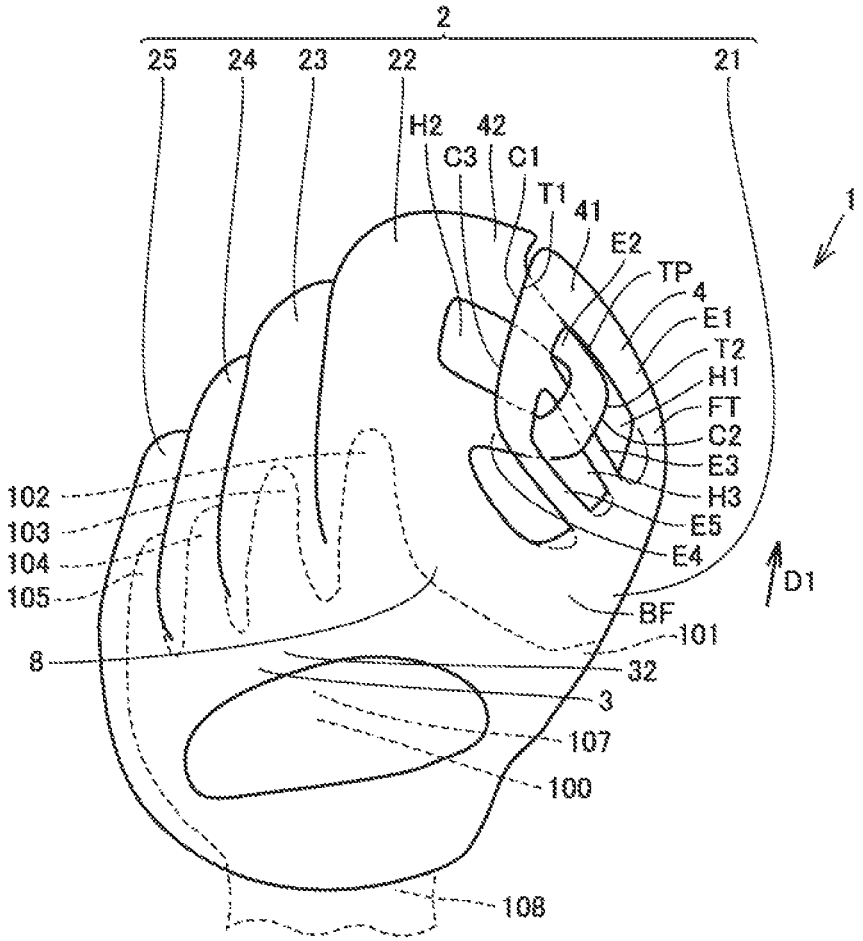
FIG. 2 is a rear view generally showing a configuration of the baseball or softball glove according to the first embodiment of the present invention as viewed from a back surface.

As illustrated in FIGS. 1 and 2, baseball or softball glove 1 according to the first embodiment of the present invention is worn on a hand 100 of a wearer (user). Baseball or softball glove 1 according to the first embodiment of the present invention mainly includes a finger part 2, a body 3, a web 4, a plurality of ball glove laces 5, and a hand insertion hole 6.

Finger part 2 is configured to receive each finger of hand 100 of the wearer. That is, finger part 2 is configured to be receive a thumb 101, an index finger 102, a middle finger 103, a ring finger 104, and a little finger 105 of hand 100 of the wearer. Finger part 2 includes a thumb part 21, an index finger part 22, a middle finger part 23, a ring finger part 24, and a little finger part 25.

Thumb part 21 is configured to receive thumb 101 of hand 100 of the wearer. Thumb part 21 and index finger part 22 include a base part BF and a fingertip part FT. Base part BF is disposed at a base of thumb pan 21. Fingertip part FT is disposed at a fingertip of thumb part 21. Index finger part 22 is configured to receive index finger 102 of hand 100 of the wearer. Middle finger part 23 is configured to receive middle finger 103 of hand 100 of the wearer. Ring finger part 24 is configured to receive ring finger 104 of hand 100 of the wearer. Little finger part 25 is configured to receive little finger 105 of hand 100 of the wearer.

Each of thumb part 21, index finger part 22, middle finger pan 23, ring finger part 24, and little finger part 25 has a bag shape so as to receive each of thumb 101, index finger 102, middle linger 103, ring finger 104, and little finger 105 of hand 100 of the wearer.

Body 3 is configured to receive and hand 100 of the wearer. Body 3 has a bag shape so as to receive hand 100 of the wearer. Body 3 is connected to thumb part 21, index finger part 22, middle finger part 23, ring finger part 24, and little finger part 25.

Body 3 includes a palm part 31 disposed on a palm 106 of hand 100 of the wearer and a back of the hand part 32 disposed on a back of the hand 107 of hand 100 of the wearer.

Palm part 31 is connected to finger part 2. That is, palm part 31 is connected to thumb part 21, index finger part 22, middle finger part 23, ring finger part 24, and little finger part 25. Palm part 31 is configured to cover palm 106 of the wearer.

Back of the hand part 32 is connected to finger part 2. That is, back of the hand part 32 is connected to thumb part 21, index finger part 22, middle finger part 23, ring finger part 24, and little finger part 25. Back of the hand part 32 is configured to be along back of the hand 107 of hand 100 of the wearer.

Web 4 is disposed between thumb part 21 and index finger part 22. Web 4 is configured to cover at least a part of a region between thumb part 21 and index finger part 22. Web 4 has a movable structure at its center.

Web 4 includes a first protrusion 41 and a second protrusion 42. First protrusion 41 protrudes from thumb part 21 toward index finger part 22. First protrusion 41 is formed integrally with thumb part 21. Note that first protrusion 41 may be formed separately from thumb part 21. First protrusion 41 has a first through hole H1. First protrusion 41 has a substantially E-shape. First protrusion 41 has a first tip T1. First tip T1 is located close to index finger part 22, and is an outer edge of a first bent part C1 and a third bent part C3 described later. First tip T1 is disposed closer to index finger part 22 than a second tip T2. First protrusion 41 is not fixed to second protrusion 42. That is, first protrusion 41 is not fixed by, for example, being sewn to second protrusion 42.

Second protrusion 42 protrudes from index finger part 22 toward thumb part 21. Second protrusion 42 is formed integrally with index finger part 22. Note that second protrusion 42 may be formed separately from index finger part 22. Second protrusion 42 has a second through hole 112. Second protrusion 42 has a substantially U-shape. Second protrusion 42 has second tip T2. Second tip T2 is located close to thumb part 21, and is an outer edge of a second bent part C2 described later. Second tip T2 is disposed closer to thumb part 21 than first tip T1.

At least either first through hole H1 or second through hole H2 has an inclined edge that extends obliquely upward from a base of thumb part 21 or index finger part 22 on a peripheral edge forming the through hole. The peripheral edge is a part surrounding at least either first through hole H1 or second through hole H2. The inclined edge is a part extending obliquely upward from the base of thumb part 21 or index finger part 22. In the present embodiment, the inclined edge is provided on the peripheral edge forming first through hole H1. First protrusion 41 and second protrusion 42 are engaged with each other in a state where first through hole H1 and second through hole H2 are connected to each other in a chain shape.

First protrusion 41 and second protrusion 42 are configured to be relatively movable by opening and closing baseball or softball glove 1. First protrusion 41 and second protrusion 42 are configured to be locked to each other. The substantially E-shape of first protrusion 41 and the substantially U-shape of second protrusion 42 are configured to be inserted into and engaged with each other.

First tip T1 and second tip T2 are configured to e relatively movable by opening and closing baseball or softball glove 1. A distance between first tip T1 and second tip T2 is configured to be changeable by opening and closing baseball or softball glove 1. Specifically, the distance between first tip T1 and second tip T2 are configured to be closer when baseball or softball glove 1 is opened, and to be farther when baseball or softball glove 1 is closed.

First protrusion 41 includes a first extension E1 and first bent part C1. First extension E1 extends from thumb part 21 toward index finger part 22. First extension E1 extends linearly from thumb part 21 toward index finger part 22. First bent part C1 is bent from first extension E1. First bent part C1 is bent from first extension E1 toward the region between thumb part 21 and index finger part 22.

Second protrusion 42 includes a second extension E2 and second bent part C2. Second extension E2 extends from index finger part 22 toward thumb part 21. Second extension E2 extends linearly from index finger pan 22 toward thumb part 21. Second bent part C2 is bent from second extension E2. Second bent part C2 is bent from second extension E2 toward the region between thumb part 21 and index finger part 22.

First bent part C1 is disposed closer to index finger part 22 than second bent part C2. First bent part C1 is disposed closer to a back surface 8 than second extension E2.

Second bent part C2 is disposed closer to thumb part 21 than first bent part C1. Second bent part C2 is disposed closer to back surface 8 than a third extension E3.

First bent part C1 and second bent part C2 are configured to be locked to each other by opening and closing baseball or softball glove 1. First bent part C1 and second bent part C2 are configured such that an inner end of first bent part C1 located dose to thumb part 21 and an inner end of second bent part C2 located close to index finger part 22 can be locked to each other.

First bent part C1 may be disposed closer to a ball receiving surface 7 than second extension E2.

The shapes of first protrusion 41 and second protrusion 42 may be opposite to the shapes described above. That is, first protrusion 41 may have a substantially U-shape of second protrusion 42, and second protrusion 42 may have a substantially E-shape of first protrusion 41.

Second extension E2 includes a tapered part TP inclined from index finger part 22 toward thumb part 21. Tapered part TP has a tapered shape whose width decreases from index finger part 22 toward thumb part 21. Tapered part TP is disposed on a distal end of web 4 of second extension E2. The distal end of web 4 is a part of web 4 dose to the fingertip. That is, tapered part TP is disposed on second extension E2 on an opposite side of second through hole H2.

Tapered part TP is configured to be slidable on at least either first extension E1 or first bent part C1 by opening and dosing baseball or softball glove 1. Tapered part TP is configured to be slidable on at least either an inner end of first extension E1 close to a base of web 4 or an inner end of first bent part C1 close to the base of web 4. The base of web 4 is a part of web 4 close to body 3.

First protrusion 41 includes third extension E3. Third extension E3 extends from thumb part 21 toward index finger part 22. Third extension E3 extends linearly from thumb part 21 toward index finger part 22. Third extension E3 is connected to first bent part C1. Third extension E3 is connected to first bent part C1 closer to the base of web 4 than first extension E1.

Third extension E3 extends obliquely with respect to an extending direction D1 in which thumb part 21 extends from base part BF toward fingertip part FT, and extends away from base part BF from thumb part 21 toward first bent part C1 in extending direction D1.

Second protrusion 42 includes a fourth extension E4. Fourth extension E4 extends from index finger part 22 toward thumb part 21. Fourth extension E4 extends linearly from index finger part 22 toward thumb part 21. Fourth extension E4 is connected to second bent part C2. Fourth extension E4 is connected to second bent part C2 closer to the base of web 4 than second extension E2.

Second protrusion 42 is inserted into first through hole H1. At least either second extension E2 or second bent part C2 is inserted into first through hole H1. First through hole H1 is surrounded by thumb part 21, first extension E1, first bent part C1, and third extension E3.

First protrusion 41 is inserted into second through hole H2. At least either third extension E3 or first bent part C1 is inserted into second through hole H2. Second through hole H2 is surrounded by index finger part 22, second extension E2, second bent part C2, and fourth extension E4. Second through hole H2 has a substantially rectangular shape.

Since first protrusion 41 is inserted into second through hole H2 and second protrusion 42 is inserted into first through hole H1, first protrusion 41 and second protrusion 42 are connected to each other so as to be relatively movable.

Second protrusion 42 is configured to be movable in first through hole H1, and first protrusion 41 is configured to be movable in second through hole H2 by opening and closing the baseball or softball glove.

Web 4 is configured such that a distance between an end of first protrusion 41 dose to index finger part 22 and index finger part 22 and a distance between an end of second protrusion 42 close to thumb part 21 and thumb part 21 can be changed by first protrusion 41 moving in second through hole H2 and second protrusion 42 moving in first through hole H1.

Second extension E2 has a smaller width than first through hole H1. That is, in a direction from first extension E1 toward third extension E3 across first through hole H1, the width of second extension E2 is smaller than a hole diameter of first through hole H1.

Third extension E3 has a smaller width than second through hole H2. That is, in a direction from second extension E2 toward fourth extension E4 across second through hole H2, the width of third extension E3 is smaller than a hole diameter of second through hole H2.

First protrusion 41 includes the third bent part C3 and fifth extension E5. Third bent part C3 is bent from third extension E3. Third bent part C3 is bent from third extension E3 to an opposite side of first bent part C1.

Third bent part C3 is disposed closer to index finger part 22 than second bent part C2. Third bent part C3 is disposed closer to back surface 8 than fourth extension E4.

Third bent part C3 and second bent part C2 are configured to be locked to each other by opening and closing baseball or softball glove 1. Third bent part C3 and second bent part C2 are configured such that an inner end of third bent part C3 located dose to thumb part 21 and an inner end of second bent part C2 located dose to index finger part 22 can be locked to each other.

Fifth extension E5 extends from thumb part 21 toward index finger part 22. Fifth extension E5 extends linearly from thumb part 21 toward index finger part 22. Fifth extension E5 is connected to third bent part C3. Fifth extension E5 is connected to third bent part C3 closer to the base of web 4 than third extension E3.

First protrusion 41 has a third through hole H3 closer to base part BF than first through hole H1. Second protrusion 42 is inserted into third through hole H3. At least either fourth extension E4 or second bent part C2 is inserted into third through hole H3. Third through hole H3 is surrounded by thumb part 21, third extension E3, third bent part C3, and fifth extension E5.

Second protrusion 42 is configured to be movable in third through hole H3 by opening and closing baseball or softball glove 1. In the present embodiment, second protrusion 42 is configured to be movable in first through hole H1 or third through hole H3 by opening and closing baseball or softball glove 1.

On a distal end of first protrusion 41, third through hole H3 has a larger width than first through hole H1. On a connecting part between first protrusion 41 and thumb part 21, third through hole H3 has a smaller width than first through hole H1.

Third through hole H3 is disposed closer to hand insertion hole 6 than first through hole H1. That is, first through hole H1 is disposed close to the distal end of web 4, and third through hole H3 is disposed close to the base of web 4.

First protrusion 41 has first extension E1 above first through hole H1, third extension E3 below first through hole H1, and fifth extension E5 below third through hole H3. Second protrusion 42 has second extension E2 above second through hole H2 and has fourth extension E4 below second through hole H2. Second extension E2 is inserted into first through hole H1. Third extension E3 is inserted into second through hole H2. Fourth extension E4 is inserted into third through hole H3. First protrusion 41 and second protrusion 42 are engaged with each other in a state where third extension E3 and second through hole H2 between first through hole H1 and third through hole H3 are connected to each other in a chain shape. There is an inclined edge at first through hole H1, close to base part BF.

In the first embodiment of the present invention, a plurality of through holes is provided in thumb part 21 and first protrusion 41, but only one through hole may be provided. Although one through hole is provided in index finger part 22 and second protrusion 42, a plurality of through holes may be provided.

Some of ball glove laces 5 among the plurality of ball glove laces 5 are disposed across thumb part 21, index finger part 22, and web 4. The other ball glove laces 5 of the plurality of ball glove laces 5 are disposed across adjacent finger parts from index finger part 22 to little finger part 25. In baseball or softball glove 1 according to the first embodiment of the present invention, each of the plurality of ball glove laces 5 has a string shape. Note that the configuration of each of the plurality of ball glove laces 5 is not limited to this, and may have two crossing string shapes. In addition, ball glove laces 5 need not be provided. In this case, finger part 2 may be integrally formed.

Hand insertion hole 6 is an insertion port for inserting hand 100 of the wearer into baseball or softball glove 1. Hand insertion hole 6 is configured to be inserted by hand 100 of the wearer. Hand insertion hole 6 is provided at an end of body 3. Specifically, hand insertion hole 6 is provided at an end of each of palm part 31 and back of the hand part 32 on an opposite side of finger part 2. Hand insertion hole 6 is provided along a wrist 108 of hand 100 of the wearer.

Ball receiving surface 7 is disposed on palm 106 of hand 100 of the wearer. Ball receiving surface 7 is for receiving a ball. Ball receiving surface 7 includes parts of finger part 2, body 3, web 4, and ball glove laces 5, disposed on palm 106 of hand 100 of the wearer. Palm part 31 of body 3 constitutes a part of ball receiving surface 7.

Back surface 8 is disposed on back of the hand 107 of the wearer. Back surface 8 includes parts of finger part 2, body 3, web 4, and ball glove laces 5, disposed on back of the hand 107 of the wearer. Back of the hand part 32 of body 3 constitutes a part of back surface 8.

In the first embodiment of the present invention, finger part 2, body 3, web 4, and ball glove laces 5 include resin. Specifically, finger part 2, body 3, web 4, and ball glove laces 5 are integrally produced by using resin. Here, being integrally produced means being produced with one member.

In the first embodiment of the present invention, it is sufficient that web 4 includes resin. Finger part 2 and web 4 may include resin. Finger part 2, body 3, and web 4 may include resin.

The resin may be made of a single material. The resin may be made of a plurality of materials.

The resin may be made of an elastomer that is extensible by 100% or more when a tensile test is performed with reference to the conditions of a tensile test of JIS K 6251. Here, being extensible by 100% or more means being extensible by 100% or more until the resin (sample) is broken in the tensile test.

Specific examples of the resin include a polyurethane-based elastomer, a polyamide-based elastomer, polyester-based elastomer, a polystyrene-based elastomer, a polyolefin-based elastomer, a vinyl chloride-based elastomer, a polybutadiene-based elastomer, and a silicone rubber. The resin may be, for example, a foam of a thermoplastic synthetic resin such as ethylene-vinyl acetate copolymer (EVA) or polyethylene, a foam or a thermosetting resin such as polyurethane (PU), or a foam of a rubber material such as natural rubber or synthetic rubber. As the synthetic rubber, polyisoprene, polybutadiene, a styrene-butadiene copolymer, an acrylonitrile-butadiene copolymer, an ethylene-propylene-diene copolymer, an ethylene-propylene copolymer, polychloroprene, an isobutylene-isoprene copolymer, and the like can be used.

In the first embodiment of the present invention, since finger part 2, body 3, web 4, and ball glove laces 5 are integrally produced by using resin, there is no seam for sewing each of finger part 2, body 3, web 4, and ball glove laces 5.

Figure 3:
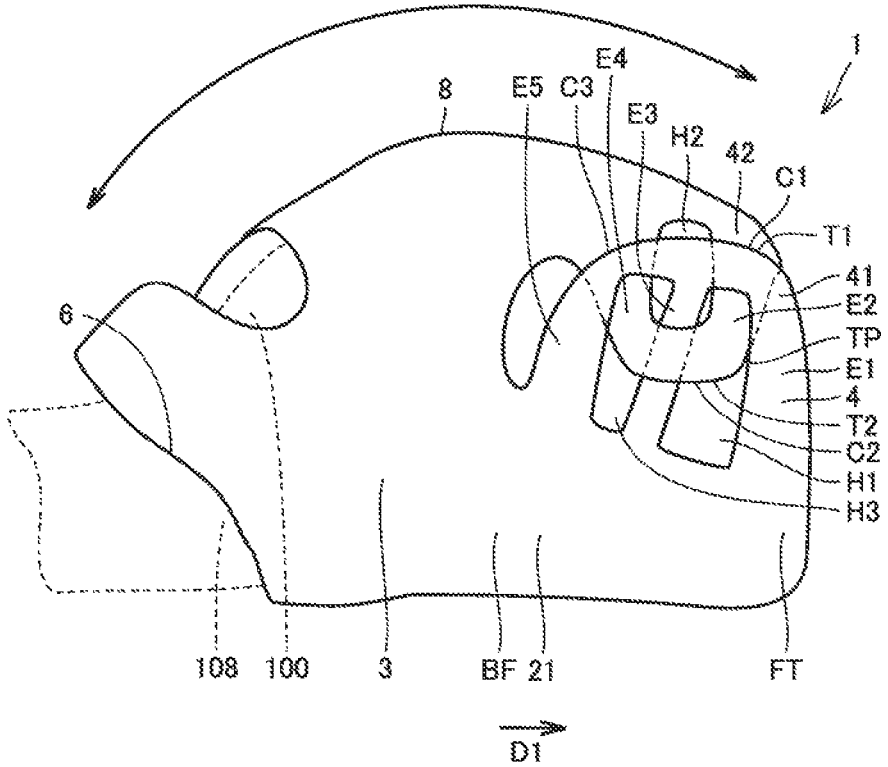
FIG. 3 is a left side view generally showing a configuration of the baseball or softball glove according to the first embodiment of the present invention as viewed from a thumb part.

As shown in FIGS. 2 and 3, in a state where baseball or softball glove 1 is not worn on hand 100 of the wearer, finger part 2 and body 3 are curved from the wrist to the fingertip of the wearer so as to protrude from palm 106 to back of the hand 107. That is, in a state where baseball or softball glove 1 is not worn on hand 100 of the wearer, an arch shape of back surface 8 is maintained so as to bulge toward the back surface from the wrist to the fingertip of the wearer as indicated by a double-headed arrow in FIG. 3. By appropriately selecting a thickness, hardness, and the like of the resin, it is possible to maintain the arch shape of back surface 8 so as to bulge toward the back surface from the wrist to the fingertip of the wearer.

Figure 4:
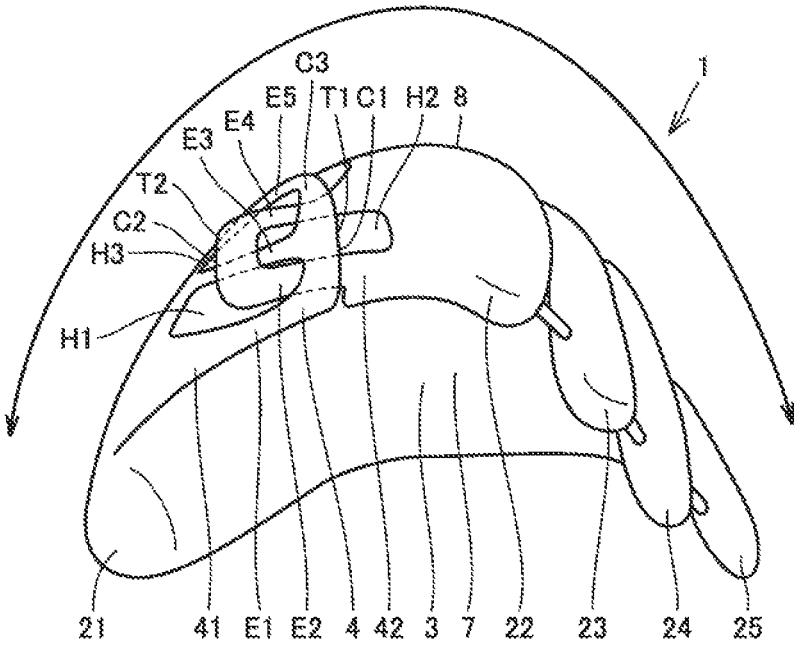
FIG. 4 is a top view generally showing a configuration of the baseball or softball glove according to the first embodiment of the present invention as viewed from a fingertip.

As shown in FIGS. 2 and 4, in a state where baseball or softball glove 1 is not worn on hand 100 of the wearer, finger part 2 and body 3 are curved from the thumb 101 to little finger 105 of the wearer so as to protrude from palm 106 to back of the hand 107. That is, in a state where baseball or softball glove 1 is not worn on hand 100 of the wearer, the arch shape of back surface 8 is maintained so as to bulge toward the back surface from thumb 101 to little finger 105 of the wearer as indicated by a double-headed arrow in FIG. 4. By appropriately selecting the thickness, hardness, and the like of the resin, it is possible to maintain the arch shape of back surface 8 so as to bulge toward the back surface from the thumb 101 to little finger 105 of the wearer.

Next, a method of manufacturing a baseball or softball glove 1 according to the first embodiment of the present invention will be described.

Baseball or softball glove 1 according to the first embodiment of the present invention is manufactured by a 3D printer (three-dimensional forming apparatus). A method of forming by the 3D printer is not limited. Examples of the method of forming by the 3D printer include material extrusion, material jetting, powder bed fusion, binder jetting, and vat photopolymerization.

The material extrusion is a method in which a filamentary thermoplastic resin (formation material) is melted in a nozzle, and the molten formation material is injected from the nozzle and laminated. The material extrusion is commonly called fused deposition modeling (FDM) or fused filament fabrication (FFF).

The material jetting is a method in which a photocurable resin is sprayed from a head and laminated while being cured with ultraviolet rays. The material jetting is commonly called ink jet type, material jetting, or MultiJet Printing (MJP).

The powder bed fusion is a method in which a laser beam is applied to spread powder to sinter and laminate the powder. The powder bed fusion is commonly called powder sintering, selective laser sintering (SLS), direct metal laser sintering (DMLS), electron beam melting (EBM), or selective laser melting (SLM).

The binder jetting is a method in which a binder (adhesive) is sprayed and fixed to spread powder and laminated. The binder jetting is commonly called ink jet type, binder jet, or color jet printing (CJP).

The vat photopolymerization is a method in which a laser beam is applied to a pool containing a liquid photocurable resin, and the resin is cured and laminated. The vat photopolymerization is commonly called optical shaping or (stereolithography) SLA.

Although an example in which linger part 2, body 3, web 4, and ball glove laces 5 including resin has been described above, the material is not limited to resin. The material may be, for example, leather.

Next, opening and closing of baseball or softball glove 1 according to the first embodiment of the present invention will be described.

With reference to FIG. 2, the distance between first tip T1 and second tip T2 becomes closer by opening baseball or softball glove 1. The distance between first tip T1 and second tip T2 becomes closest by most fully opening baseball or softball glove 1.

Figure 5:
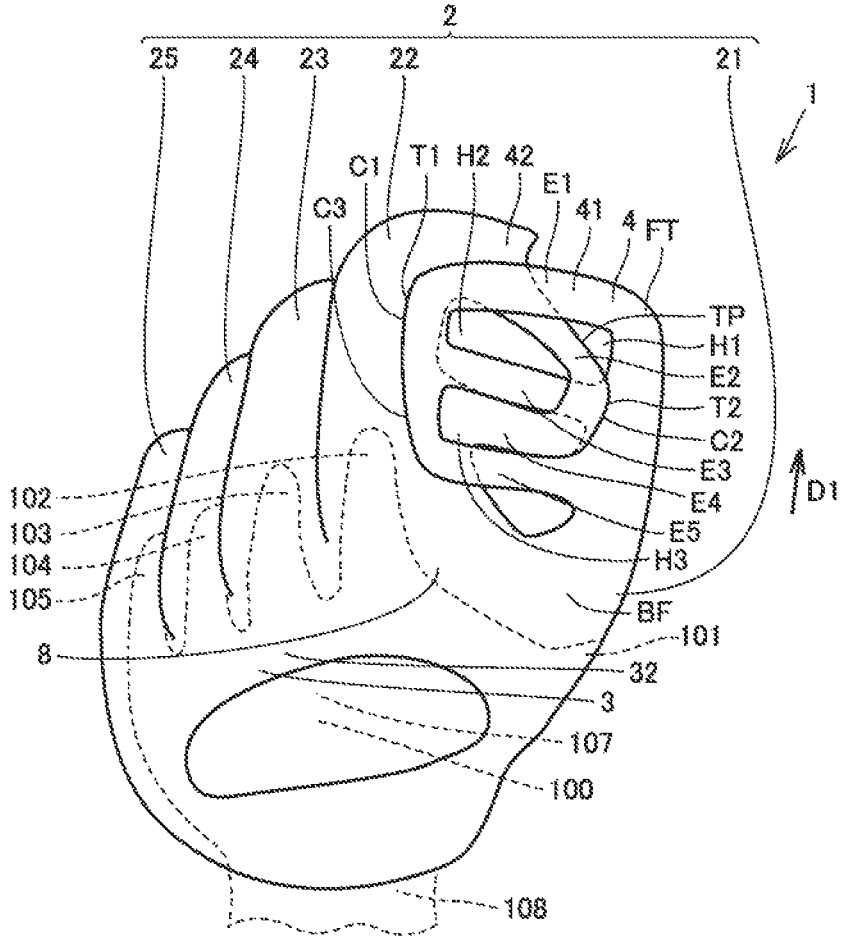
FIG. 5 is a rear view generally showing a state where the thumb part and an index finger part of the baseball or softball glove according to the first embodiment of the present invention are close to each other.

With reference to FIG. 5, when baseball or softball glove 1 is closed, first protrusion 41 and second protrusion 42 move independently so as to overlap each other. Specifically, third extension E3 of first protrusion 41 moves in second through hole H2, and second extension E2 and fourth extension E4 of second protrusion 42 move in first through hole H1 and third through hole H3. Thus, first tip T1 of first protrusion 41 moves so as to approach index finger part 22, and second tip T2 of second protrusion 42 moves so as to approach thumb part 21. Therefore, the distance between first tip T1 and second tip T2 becomes farther as baseball or softball glove 1 is closed. The distance between first tip T1 and second tip T2 becomes farthest by most fully closing baseball or softball glove 1.

With reference to FIGS. 6 to 9, a movable range of web 4 of baseball or softball glove 1 according to the first embodiment of the present invention will be described in comparison with a comparative example. FIGS. 6 to 9 schematically show web 4, thumb part 21, and index finger part 22.

Figure 6:
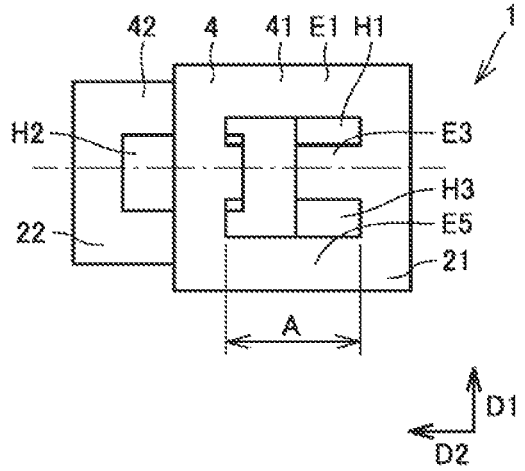
FIG. 6 is a rear view schematically showing a configuration of a web of a baseball or softball glove according to a comparative example as viewed from a back surface.

With reference to FIG. 6, in web 4 of baseball or softball glove 1 of the comparative example, third extension E3 extends in a horizontal direction D2 orthogonal to extending direction D1 When thumb part 21 and first protrusion 41 move in horizontal direction D2, a movable range A of web 4 is equal to a length of third extension E3. Movable range A of web 4 is a movable range of first protrusion 41 with respect to second protrusion 42.

Figure 7:
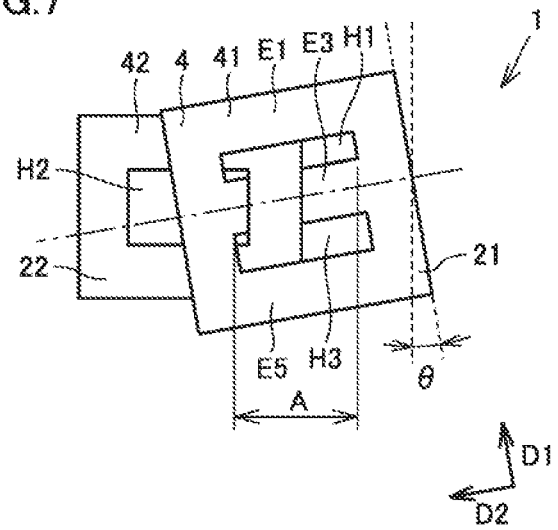
FIG. 7 is a rear view schematically showing a configuration of a baseball or softball glove according to a comparative example as viewed from a back surface of a web in a state where a thumb part and an index finger part are close to each other.

With reference to FIG. 7, in practice, when baseball or softball glove 1 of the comparative example is closed, thumb part 21 and first protrusion 41 rotate with respect to index finger part 22 and second protrusion 42. That is, thumb part 21 and first protrusion 41 rotate as compared with when baseball or softball glove 1 is opened. Thumb part 21 and first protrusion 41 rotate at a rotation angle θ. Thus, in baseball or softball glove 1 of the comparative example, movable range A of web 4 is smaller than in a case where thumb part 21 and first protrusion 41 move in horizontal direction D2 orthogonal to extending direction D1.

Figure 8:
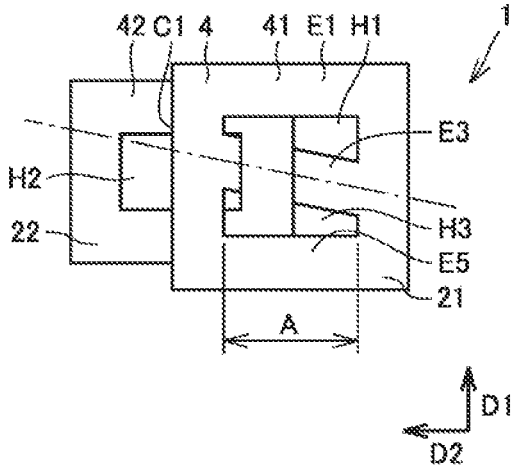
FIG. 8 is a rear view schematically showing a configuration of a web of the baseball or softball glove according to the first embodiment of the present invention as viewed from the back surface.

With reference to FIG. 8, in baseball or softball glove 1 according to the first embodiment of the present invention, third extension E3 extends obliquely with respect to extending direction D1, and extends away from base part BF (see FIG. 1) from thumb part 21 toward first bent part C1 in extending direction D1. That is, third extension E3 extends obliquely along a rotation direction of thumb part 21 and first protrusion 41 with respect to horizontal direction D2 orthogonal to extending direction D1.

Figure 9:
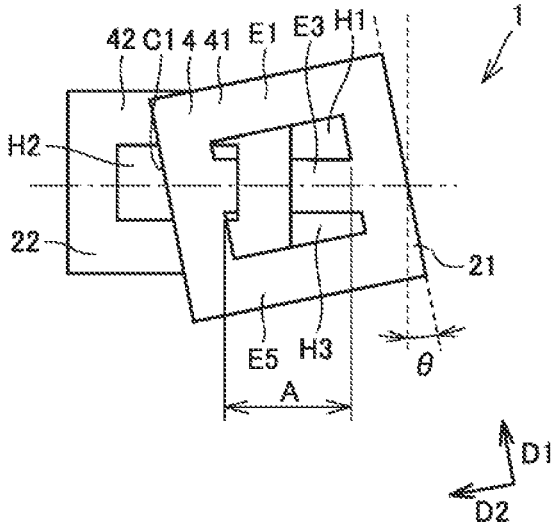
FIG. 9 is a rear view schematically showing a configuration of the baseball or softball glove according to the first embodiment of the present invention as viewed from the back surface of the web in a state where the thumb part and the index finger part are close to each other.

With reference to FIG. 9, when baseball or softball glove 1 according to the first embodiment of the present invention is closed, thumb part 21 and first protrusion 41 rotate at rotation angle θ with respect to index finger part 22 and second protrusion 42. That is, thumb part 21 and first protrusion 41 rotate at rotation angle θ as compared with when baseball or softball glove 1 is opened. Thus, baseball or softball glove 1 according to the first embodiment of the present invention can prevent movable range A of web 4 from being smaller than in a case where thumb part 21 and first protrusion 41 move in horizontal direction D2. Therefore, baseball or softball glove 1 according to the first embodiment of the present invention can expand movable range A of web 4 as compared with baseball or softball glove 1 of the comparative example.

Next, operational effects of baseball or softball glove 1 according to the first embodiment of the present invention will be described.

In baseball or softball glove 1 according to the first embodiment of the present invention, at least either first through hole H1 or second through hole H2 has an inclined edge that extends obliquely upward from the base of thumb part 21 or index finger part 22 on the peripheral edge forming the through hole. First protrusion 41 and second protrusion 42 are engaged with each other in a state where first through hole H1 and second through hole H2 are connected to each other in a chain shape. In the present embodiment, third extension E3 extends obliquely with respect to extending direction D1 in which thumb part 21 extends from base part BF toward fingertip part FT, and extends away from base part BF from thumb part 21 toward first bent part C1 in extending direction D1. Accordingly, the movable range of web 4 can be expanded. Thus, the distance between thumb part 21 and index finger part 22 of baseball or softball glove 1 can be easily reduced. This configuration makes it easy to open and dose baseball or softball glove 1.

In baseball or softball glove 1 according to the first embodiment of the present invention, first protrusion 41 and second protrusion 42 are engaged with each other in a state where third extension E3 and second through hole H2 between first through hole H1 and third through hole H3 are connected to each other in a chain shape. In the present embodiment, second protrusion 42 is inserted into third through hole H3. Therefore, the ball can be prevented from passing between first protrusion 41 and second protrusion 42 as compared with a case where second protrusion 42 is inserted only into first through hole H1.

In baseball or softball glove 1 according to the first embodiment of the present invention, on the distal end of first protrusion 41, third through hole H3 has a larger width than first through hole H1. Therefore, when thumb part 21 and first protrusion 41 rotate by dosing baseball or softball glove 1, the movable range of web 4 can be expanded.

Second Embodiment

Baseball or softball glove 1 according to a second embodiment of the present invention has a similar configuration and operational effects to those of baseball or softball glove 1 according to the first embodiment unless otherwise specified.

Figure 10:
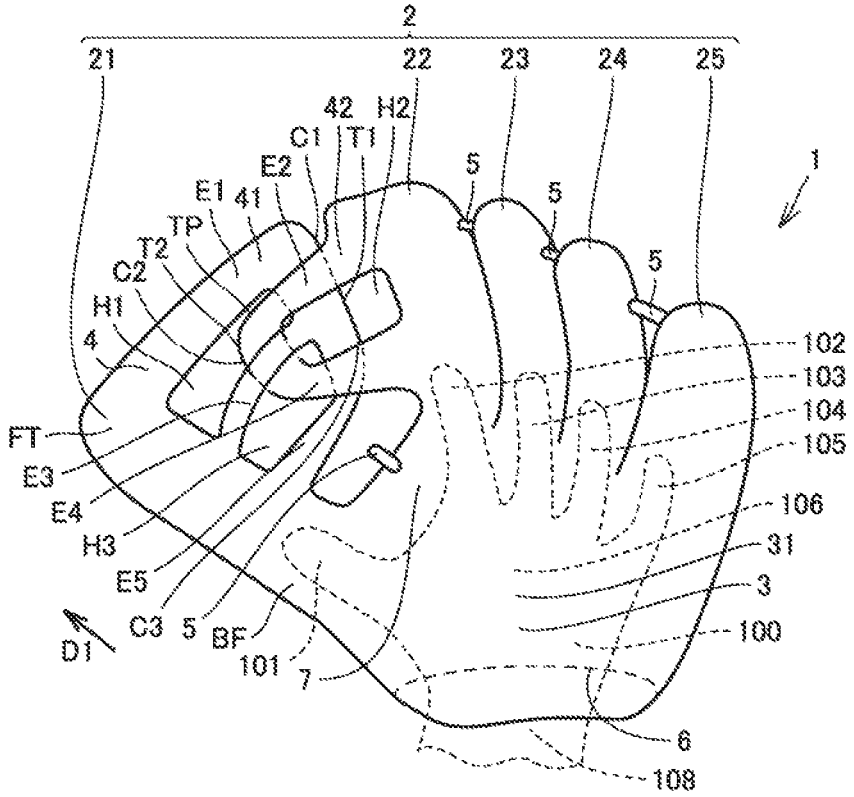
FIG. 10 is a front view generally showing a configuration of a baseball or softball glove according to a second embodiment of the present invention as viewed from a ball receiving surface.
Figure 11:
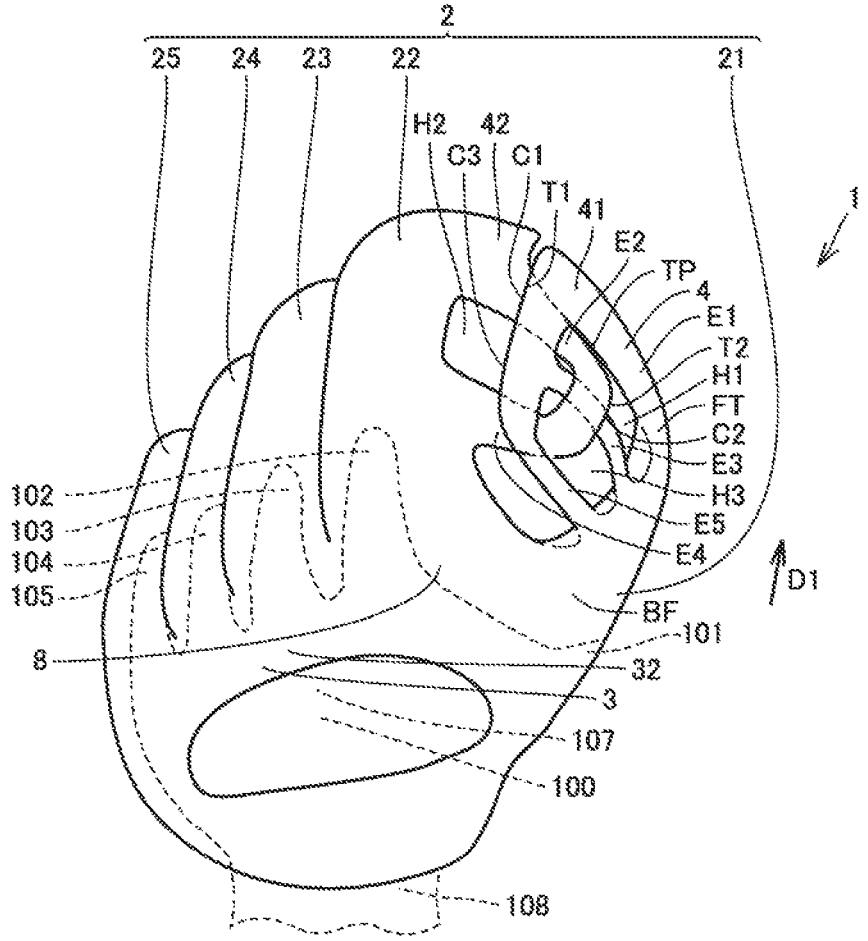
FIG. 11 is a rear view generally showing a configuration of the baseball or softball glove according to the second embodiment of the present invention as viewed from a back surface.
Figure 12:
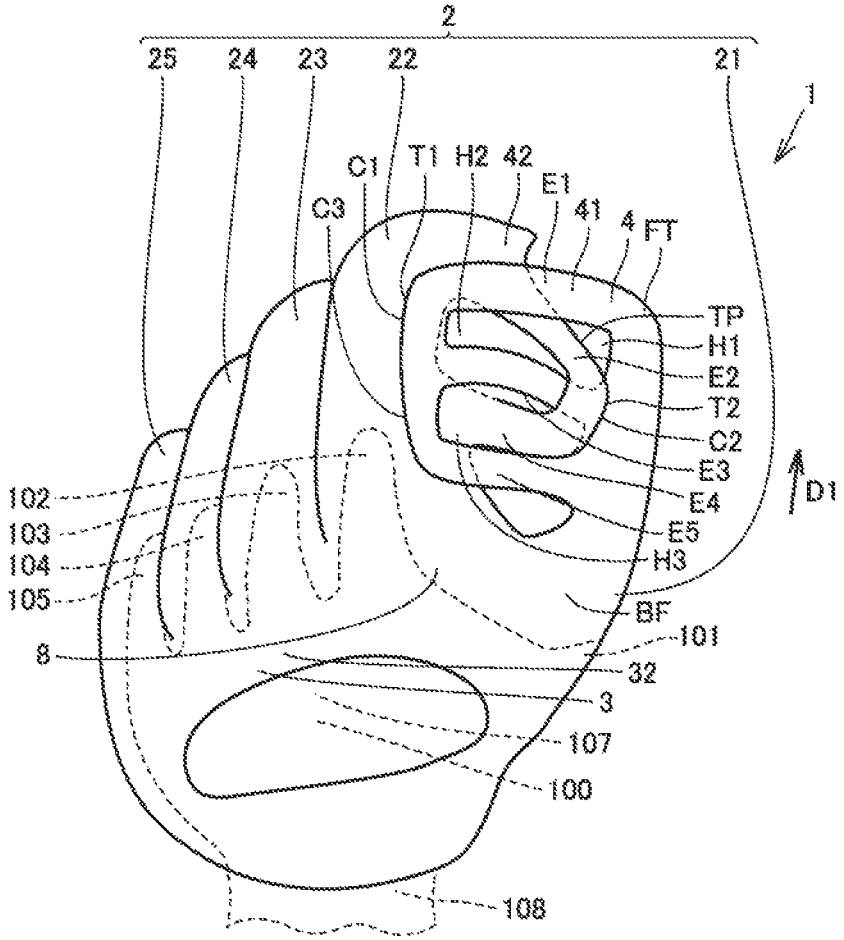
FIG. 12 is a rear view generally showing a state where the thumb part and the index finger part of the baseball or softball glove according to the second embodiment of the present invention are close to each other.

With reference to FIGS. 10 to 12, baseball or softball glove 1 according to the second embodiment of the present invention is different from baseball or softball glove 1 according to the first embodiment mainly in a shape of third extension E3.

In baseball or softball glove 1 according to the second embodiment of the present invention, third extension E3 is curved so as to protrude toward fingertip part FT in extending direction D1 in which thumb part 21 extends from base part BF toward fingertip part FT. Third extension E3 is curved in an arc shape. Third extension E3 is curved along the rotation direction of thumb part 21 and first protrusion 41 when baseball or softball glove 1 is closed.

In baseball or softball glove 1 according to the second embodiment of the present invention, third extension E3 is curved so as to protrude toward fingertip part FT in extending direction D1. Therefore, when thumb part 21 and first protrusion 41 rotate by dosing baseball or softball glove 1, the movable range of web 4 can be expanded along the rotation of thumb part 21 and first protrusion 41. Thus, when baseball or softball glove 1 is opened and closed, thumb part 21 and index finger part 22 can be smoothly moved. This configuration makes it possible to smoothly open and close baseball or softball glove 1.

Third Embodiment

Baseball or softball glove 1 according to a third embodiment of the present invention has a similar configuration and operational effects to those of baseball or softball glove 1 according to the first embodiment unless otherwise specified.

Figure 13:
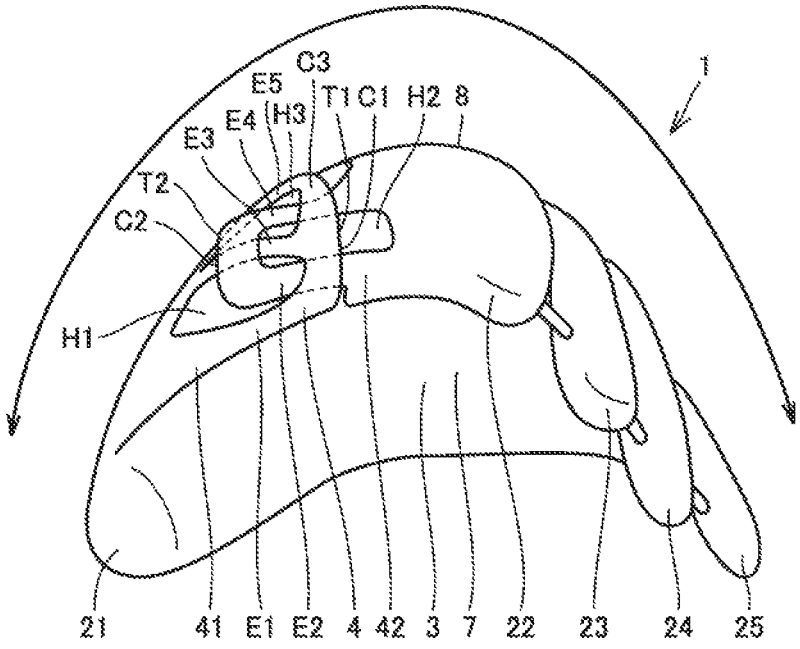
FIG. 13 is a top view generally showing a configuration of a baseball or softball glove according to a third embodiment of the present invention as viewed from a fingertip.
Figure 14:
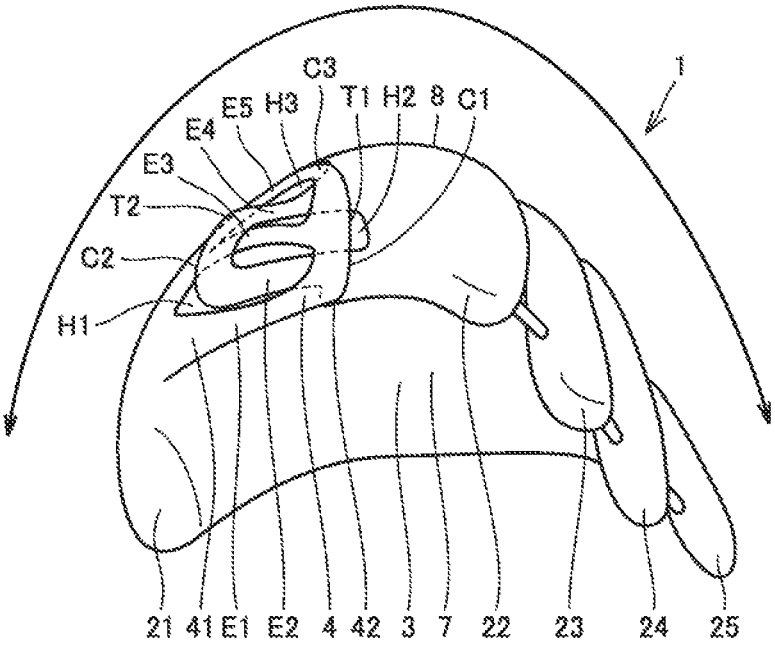
FIG. 14 is a top view generally showing a state where the thumb part and the index finger part of the baseball or softball glove according to the third embodiment of the present invention are close to each other as viewed from the fingertip.
Figure 15:
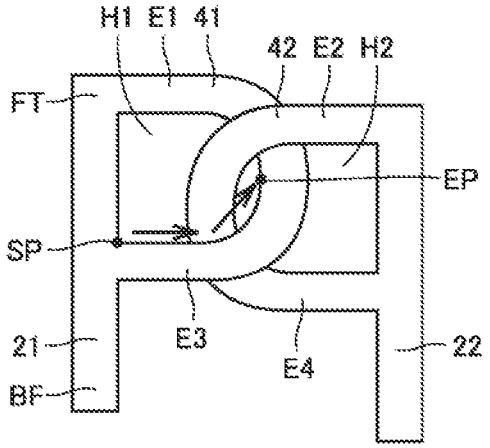
FIG. 15 is a front view schematically showing a configuration of a first protrusion and a second protrusion of a baseball or softball glove according to a fourth embodiment of the present invention as viewed from a ball receiving surface.
Figure 16:
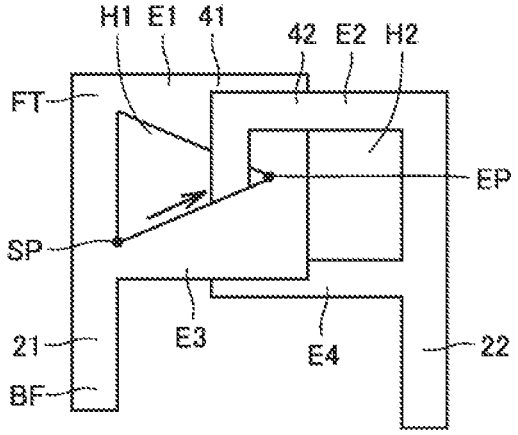
FIG. 16 is a front view schematically showing a configuration of a first protrusion and a second protrusion of Modification 1 in the baseball or softball glove according to the fourth embodiment of the present invention as viewed from the ball receiving surface.
Figure 17:
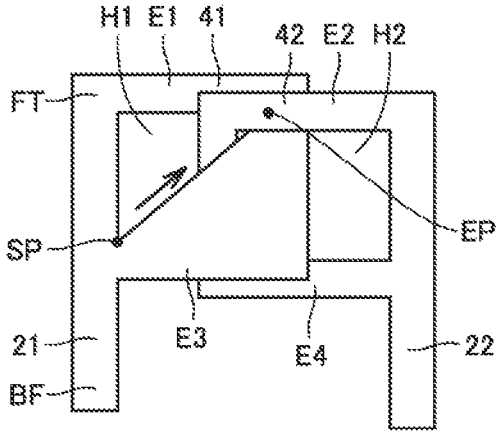
FIG. 17 is a front view schematically showing a configuration of a first protrusion and a second protrusion of Modification 2 in the baseball or softball glove according to the fourth embodiment of the present invention as viewed from the ball receiving surface.
Figure 18:
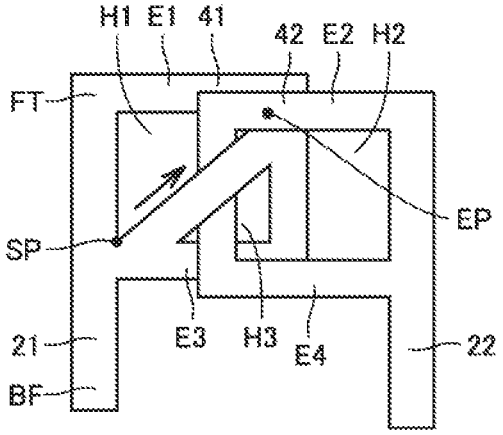
FIG. 18 is a front view schematically showing a configuration of a first protrusion and a second protrusion of Modification 3 in the baseball or softball glove according to the fourth embodiment of the present invention as viewed from the ball receiving surface.
Figure 19:
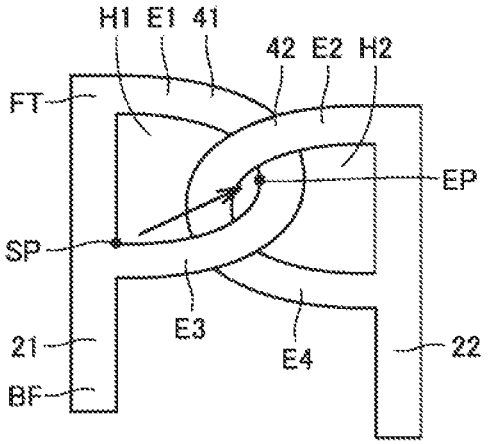
FIG. 19 is a front view schematically showing a configuration of a first protrusion and a second protrusion of Modification 4 in the baseball or softball glove according to the fourth embodiment of the present invention as viewed from the ball receiving surface.

With reference to FIGS. 13 and 14, baseball or softball glove 1 according to the third embodiment of the present invention is different from baseball or softball glove 1 according to the first embodiment mainly in the shape of third extension E3.

In baseball or softball glove 1 according to the third embodiment of the present invention, third extension E3 is curved so as to protrude toward back surface 8 of web 4. Third extension E3 is curved in an arc shape. Third extension E3 is curved along the arch shape of back surface 8 of web 4.

When the shapes of first protrusion 41 and second protrusion 42 are opposite to those described above, third extension E3 is curved so as to protrude toward ball receiving surface 7 of web 4.

In baseball or softball glove 1 according to the third embodiment of the present invention, third extension E3 is curved so as to protrude toward back surface 8 or ball receiving surface 7 of web 4. Therefore, when baseball or softball glove 1 is closed, the movable range of web 4 can be expanded along back surface 8 or ball receiving surface 7 of web 4. Thus, when baseball or softball glove 1 is opened and closed, thumb part 21 and index finger part 22 can be smoothly moved. This configuration makes it possible to smoothly open and close baseball or softball glove 1.

Fourth Embodiment

Baseball or softball glove 1 according to a fourth embodiment of the present invention has a similar configuration and operational effects to those of baseball or softball glove 1 according to the first embodiment unless otherwise specified. FIGS. 15 to 19 schematically show first protrusion 41 and second protrusion 42.

With reference to FIGS. 15 to 19, baseball or softball glove 1 according to the tough embodiment of the present invention and baseball or softball glove 1 according to Modifications 1 to 4 of the present embodiment are different from baseball or softball glove 1 according to the first embodiment mainly in the shapes of first protrusion 41 and second protrusion 42.

A start point SP of the inclined edge is located at any point between thumb part 21 and index finger part 22, close to base part BF on the peripheral edge of first through hole H1 or second through hole H2. An end point EP of the inclined edge only needs to be located closer to the fingertip than start point SP, and to be located at any point between base part B and fingertip part FT. The inclined edge may include not only a complete inclined part but also a flat region. The inclined edge need not be a straight line.

The above embodiments can be appropriately combined.

Although the embodiments of the present invention have been described above, it should be understood that the embodiments disclosed herein are illustrative in all respects and not restrictive. The scope of the present invention is indicated by the claims, and it is intended that all modifications within the meaning and scope of the claims are included in the present invention.

What is claimed is:

1. A baseball or softball glove to be worn on a hand of a wearer, the glove comprising:

a thumb part capable of receiving a thumb of the hand of the wearer;

an index finger part capable of receiving an index finger of the hand of the wearer; and a web disposed between the thumb part and the index finger part, wherein, the thumb part and the index finger part each include a base part and a fingertip part, and the web includes:

a first protrusion that protrudes from the thumb part toward the index finger part, the first protrusion defining a first through hole, and a second protrusion that protrudes from the index finger part toward the thumb part, the second protrusion defining a second through hole, at least either the first through hole or the second through hole defines an inclined edge that extends obliquely upward from the base part of the thumb part or the base part of the index finger part on a peripheral edge forming either the first through hole or the second through hole, and the first protrusion and the second protrusion are engaged with each other in a state where the first through hole and the second through hole are engaged with each other by a portion of the first protrusion and the second protrusion, wherein:

the first protrusion defines a third through hole located on a distal end of the first protrusion and nearer the base part than the first through hole, wherein the third through hole has a width greater than a width of the first through hole at an end farthest from the base part and a width less than a width of the first through hole at an end nearest to the base part, the first protrusion has a first extension disposed distal the first through hole, a third extension disposed between the first through hole and the third through hole, and a fifth extension disposed proximate the third through hole, the second protrusion has a second extension disposed distal the second through hole and a fourth extension disposed proximate the second through hole, the second extension is inserted at least partially into the first through hole, the third extension is inserted at least partially into the second through hole, the fourth extension is inserted at least partially into the third through hole, the first protrusion and the second protrusion are engaged with each other in a state where the third extension and the second through hole are engaged with each other by the first extension and the fifth extension of the first protrusion, and the inclined edge is provided on the peripheral edge of the first through hole or the second through hole closest to the base of the thumb part or the index finger part.

2. The baseball or softball glove according to claim 1, wherein the third extension is curved to protrude toward the first extension.

3. The baseball or softball glove according to claim 1, wherein the third extension is curved to protrude toward a back surface or a ball receiving surface of the web.

* * * * *